United States Patent [19]

Peddinghaus

[11] 4,164,158

[45] Aug. 14, 1979

[54] PUNCHING APPARATUS

[76] Inventor: Rolf Peddinghaus, Deterbergerstrasse 25, Ennepetal, BRD, Fed. Rep. of Germany, 5828

[21] Appl. No.: 890,480

[22] Filed: Mar. 27, 1978

[30] Foreign Application Priority Data

Mar. 29, 1977 [DE] Fed. Rep. of Germany ... 7709876[U]

[51] Int. Cl.[2] ..... B26F 1/02

[52] U.S. Cl. ..... 83/191; 83/559; 83/560; 83/623

[58] Field of Search ..... 83/188, 191, 623, 559, 83/560

[56] References Cited

U.S. PATENT DOCUMENTS

| | | | |
|---|---|---|---|
| 2,774,426 | 12/1956 | Sharpe | 83/210 |
| 3,227,022 | 1/1966 | Evans et al. | 83/623 X |
| 3,640,167 | 2/1972 | Axtmann | 83/623 X |
| 4,073,176 | 2/1978 | Paul | 83/623 X |

*Primary Examiner*—Frank T. Yost

*Attorney, Agent, or Firm*—Dressler, Goldsmith, Clement, Gordon & Shore, Ltd.

[57] ABSTRACT

A punching apparatus comprising a C-shaped frame having a first movable punch disposed in one limb of the frame and a second fixed punch disposed in the other limb of the frame. The frame is pivotally mounted on a supporting base and is guided relative to the base through a cylindrical column connected to the base which is mounted in a bore of the frame, which bore extends parallel to the direction of the punches. A further support is provided for guiding the frame including a stud which is secured to the frame, which stud extends into a slot in the supporting base.

7 Claims, 2 Drawing Figures

PUNCHING APPARATUS

Figure 1:
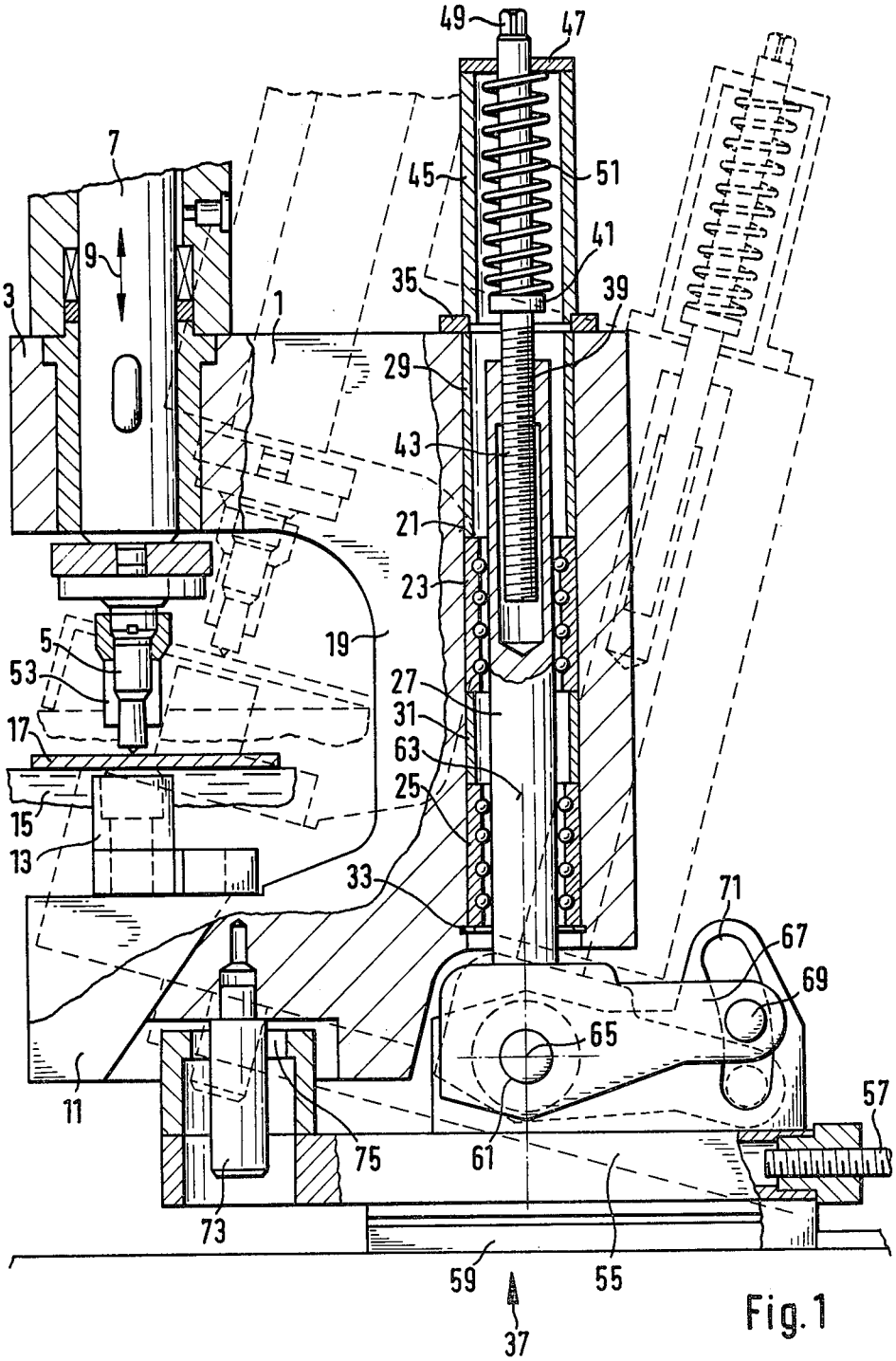

The invention relates to a punching apparatus having two punchs which are carried on opposite limbs of a C-shaped frame and one of which is displaceable and the other fixed on the associated limb, the frame in turn being displaceable on a guide in the direction of thrust of one of the punches, and the guide being mounted to pivot about an axis extending at right angles to the direction of thrust of the frame, and being adapted to be immobilized on a supporting base.

A punching apparatus of this kind is disclosed in U.S. Pat. No. 2,774,426. Holes for accommodating valves are intended to be punched in wheel rims with the aid of this appartus. The wheel rims are advanced to the punching apparatus along rails on a bench on which the guide for the frame of this punching apparatus is also pivotably mounted. The direction in which the punches operate can thus be inclined relatively to the bench and can be suitably disposed in relation to the rim. A spring engages between the frame and the guide and biases the frame in the direction in which the displaceable punch operates. When punching the holes for the valves, a hydraulic drive, which engages between the displaceable punch and the frame, advances the displaceable punch onto the wheel rim and then also pulls the frame with the punch secured thereto onto the wheel rim, the hydraulic drive being supported on the displaceable punch.

In order to enable punching to be carried out at precisely predetermined points when using apparatus of this kind, it is necessary for the frame to be guided in a precise manner. The guide of the known punching apparatus is formed by a rail of U-shaped cross-section which encloses the web of the frame at that side facing away from the punches. Provided on the edges of the limbs of the rail are strips which engage behind guide ribs on the frame that extend in the direction of thrust. However, guides of this kind result in a relatively costly construction. Furthermore, they are unable to prevent swinging movements of the frame about an axis parallel to the direction of thrust, even when the clearance is small. Such clearance can occur if the guide faces of the rail and of the guide ribs suffer only slight damage, and it makes it impossible to locate the punched hole in a precise manner.

The object of the invention is to guide the displaceable frame of the initially described punching apparatus in a precise manner, using simple constructional means.

According to the invention, this object is achieved in that the frame is guided on a cylindrical column which is mounted in a bore, formed in the frame and extending parallel to the direction of thrust of one of the punches, and which is mounted on the supporting base at one of its ends to pivot about the axis extending at right angles to the direction of thrust, and in that the frame is guided relatively to the supporting base on a stud which extends into a guide slot, the faces of which extend along planes at right angles to the pivot axis of the column.

Cylindrical columns and bores performing a bearing function can be formed with precision at relatively little cost. The stud extending into the guide slot prevents pivotal movements of the frame about the axis of the column and guides the frame along the column both during pivotal movements of the column and during displacement of the frame.

The slot is preferably formed in a portion of the supporting base that is brought adjacent the nearest limb of the frame, whereas the stud preferably projects outwardly in the plane of the frame. In this way the distance between the slot-and-stud guide and the axis of the column can be increased and the guide movement rendered more precise.

The frame can be guided on the column in a particularly smooth manner at no particularly great cost if the column is guided in the bore of the frame by means of at least one ball box. Guiding by means of ball boxes over the entire length of the bore is not necessary; it suffices to provide spaced ball boxes. Expediently the ball boxes are then secured against axial movement in the bore of the frame by means of spacing sleeves.

To enable the inclination of the column and therefore that of the direction in which the punch operates to be set and fixed relatively to the workpiece to be punched, a lever, which preferably projects radially of the axis of rotation of the column, is secured to and rotates with the column, the free end of which lever is guided in a sliding block and can be immobilized. For example, a clamping screw extending through the sliding block can be carried on the lever, and with the help of this clamping screw the lever can be clamped on the sliding block.

The spring which biases the frame towards the guide, i.e., which damps down the movement of the frame, is preferably provided on that side of the frame facing away from the supporting base. The working height of the frame can be adjusted if a screwed spring, carrying an annular flange on which the frame is supported, is screwed coaxially into that end of the column remote from the supporting base. For the purpose of damping down its movement, the frame is preferably supported on the annular flange by way of a helical spring surrounding the screwed spindle. For this purpose a backing member is provided on the frame on that side of the annular flange remote from the column. Optionally, the frame may have a further backing member on that side of the annular flange presented to the column, on which further backing member is supported a further helical spring likewise engaging the annular flange and biasing the frame towards its rest position. An important advantage of this arrangement is the small distance between the supporting base and the nearer limb of the frame. The punching apparatus can thus be rendered more versatile since it can be better adapted to suit the spatial conditions at the place where it is fixed.

Figure 2:
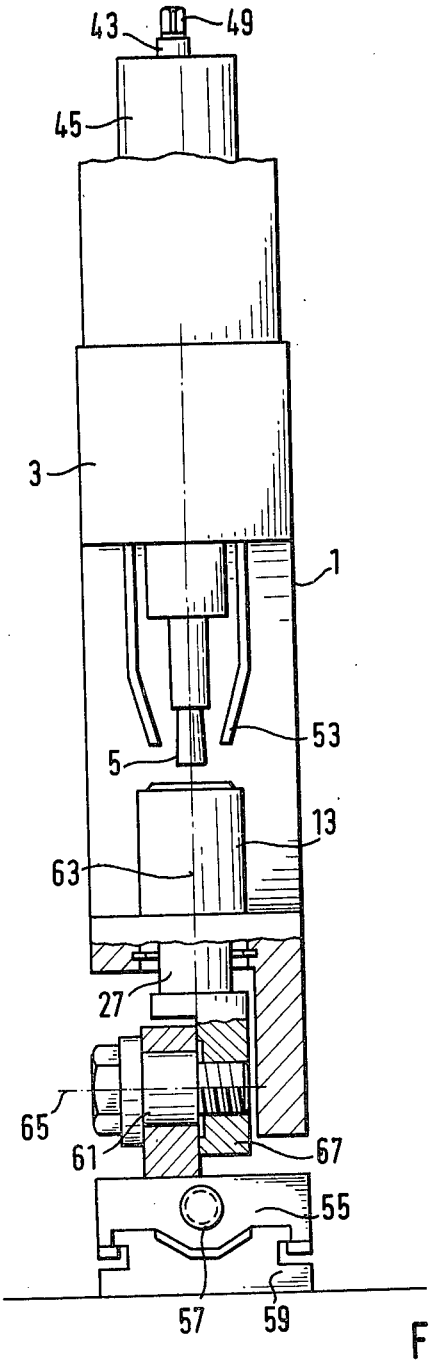

An embodiment of the invention will now be described in greater detail by reference to the attached drawings, in which:

FIG. 1 is a partially fragmented side view of a punching apparatus in accordance with the invention; and FIG. 2 is a partially fragmented front view of the punching apparatus of FIG. 1.

The punching apparatus illustrated in the figures has a substantially C-shaped frame 1 in the upper limb 3 of which a plunger 7, provided with a punch 5, can be displaced, in the direction indicated by the double-headed arrow 9, by a power source, not illustrated, for example, a hydraulic drive which engages between the frame 1 and the plunger 7. Opposite the punch 5 along the direction of thrust, a die 13 is secured to the other limb 11 of the frame 1, into which die the punch 5 moves during the punching of a workpiece 17 advanced, for example, over a roller bed 15.

Formed in the web 19 of the frame 1 is a bore 12 which extends parallel to the direction of thrust of the plunger 7 and in which is located a column 27 guided by ball boxes 23 and 25. The ball boxes 23 and 25 are secured against axial movement by means of spacing sleeves 29 and 31 between a circlip 33 and a shoulder 35, and they enable the frame 1 to be displaced smoothly along the column 27.

At its lower end the column is mounted on a supporting base 37, and at its opposite end it has a coaxial screw-threaded bore 39 into which is screwed a screwed spindle 43 which has a flange 41 above the column 27. Secured on the frame 1 and coaxially with the bore 21 is a spring housing 45 which serves as a backing member and through the cover 47 of which projects the free end of the screwed spindle 43, which end has faces 49 whereby it can be engaged by a spanner. On the unthreaded portion of the screwed spindle 43 that is located between the flange 41 and the cover 47 is mounted a helical spring 51 by way of which the frame 1 is supported on the column 27. By turning the screwed spindle 43, the distance of the frame 1 from the supporting base 37, i.e., from the roller bed 15 carrying the workpiece 17 can be adjusted.

During punching, the power source engaging between the frame 1 and the plunger 7 first pushes the plunger 7 towards the die 13 until the punch 5 bears against the workpiece 17. Since the power source is supported on the workpiece 17 by way of the plunger 7 and the punch 5, it pulls the frame 1 upwards during the further course of its operating stroke and therefore pulls the die 13 towards the punch 5. After the workpiece 17 has been punched, the power source pulls the punch 5 out of the workpiece 17 thereby overcoming resistance offered by a stripping device 53 carried on the frame 1. When the column 27 is in the vertical or inclined position, the helical spring 51 damps the falling movement of the frame 1. If the column 27 is disposed in a horizontal plane, the frame must be retracted into its rest position by a further spring. The further spring may likewise be of helical shape and may engage for example that side of the flange 41 remote from the helical spring 51, between the flange and the frame 1.

The supporting base 37 comprises a slide 55 which can be horizontally displaced along a rail 59 by means of a further screwed spindle 57. As best seen from FIG. 2, the lower end of the column 27 can be pivoted in a hinge 61 about a horizontal axis 65 extending at right angles to the axis 63 of the column. Thus, as shown in broken lines in FIG. 1, the punching apparatus can be swung and, by means of the screwed spindles 49 and 57, disposed to suit any position of the workpiece advanced on the roller bed 15. A lever 67, projecting at right angles to the axis of swing 65 from that part of the hinge 61 associated with the column, serves to secure the column 27 in any position into which it is swung. The lever 67 is securely connected to the column 27 and, at its free end, carries a clamping device 69, for example, a clamping screw, which extends through a slide block 71 of the slide 55.

Swinging movements of the frame 1 around the axis 63 of the column are prevented by a stud 73 which projects downwardly from the limb 11 and extends into a guide slot 75 formed in the slide 55. The longitudinal walls of the guide slot 75 extend along planes at right angles to the axis of swing 65 and guide the stud 73 in any of the positions about the axis 65 into which it is swung, i.e., in any of its vertical positions determined by the screwed spindle 43.

It is, of course, intended to cover by the appended claims all of such modifications as fall within the true spirit and scope of the invention.

What is claimed is:

1. A punching apparatus comprising a frame that is generally C-shaped in that it defines two outwardly extending limbs, a first movable punch disposed in one of said limbs and a second fixed punch disposed in the other of said limbs, a supporting base, guide means for supporting said frame in the direction of thrust of one of said punches, means for pivotally mounting said guide means on said base about an axis extending at right angles to the direction of thrust of the frame, said guide means comprisng a cylindrical column mounted in a bore defined by said frame and extending parallel to the direction of thrust of one of the punches, means for pivotally mounting the column relative to said base and means for guiding the frame relative to the supporting base including a slot defined by said supporting base and a stud secured to said frame, the faces of said stud and slot extending along planes at right angles to the pivot axis of said column.

2. A punching apparatus according to claim 1 in which the slot is formed in a portion of the supporting base adjacent the nearest limb of the frame and the stud extends from said nearest limb.

3. A punching apparatus according to claim 2 in which the stud projects outwardly in the plane of the frame.

4. A punching apparatus according to claim 1 in which the column is supported relative to said frame by a ball box assembly disposed in said bore between the column and the frame.

5. A punching apparatus according to claim 1 in which the column is supported relative to said frame by a plurality of ball box assemblies disposed in said bore between the column and the frame, which assemblies are secured against axial movement in the bore by means of spacing sleeves.

6. A punching apparatus according to claim 1 in which the means for pivotally mounting the guide means includes a lever projecting radially of the axis of rotation of the column, which lever is secured to and rotates with the column, and means for guiding said lever to various positions to regulate the tilting position of the frame, and means for locking said column and associated frame in a predetermined position.

7. A punching apparatus in accordance with claim 1 including means for resiliently supporting said frame relative to said column comprising an adjustable spindle screwed into the end of said column remote from the supporting base and having an annular flange, a backing member connected to the frame on that side of the annular flange remote from the column and a helical spring surrounding the spindle and located between the annular flange and the backing member.

* * * * *